United States Patent [19]

Facemire

[11] 3,968,606

[45] July 13, 1976

[54] PORTABLE ROSTRUM

[76] Inventor: Odie D. Facemire, Clark Road, Shirley, Mass. 01464

[22] Filed: Aug. 30, 1974

[21] Appl. No.: 501,996

Related U.S. Application Data

[60] Continuation of Ser. No. 311,629, Dec. 4, 1972, abandoned, which is a division of Ser. No. 141,942, May 10, 1971, abandoned, which is a continuation of Ser. No. 39,647, May 22, 1970, abandoned, which is a division of Ser. No. 849,561, July 23, 1969, Pat. No. 3,531,898, which is a continuation of Ser. No. 640,590, May 23, 1967, abandoned.

[52] U.S. Cl. ..... 52/127; 52/6; 52/126; 52/263; 108/90; 108/157

[51] Int. Cl.[2] ..... E04H 3/10

[58] Field of Search ..... 52/6, 7, 126, 127, 122, 52/263, 476; 108/157, 158, 159, 90; 248/188; 312/195; 49/465

[56] References Cited

UNITED STATES PATENTS

| | | | |
|---|---|---|---|
| 1,946,917 | 2/1934 | Ross | 52/476 X |
| 2,849,764 | 9/1958 | Rich et al. | 49/465 X |
| 3,067,843 | 12/1962 | Rushtoh et al. | 52/263 X |
| 3,094,848 | 6/1963 | Albrecht | 52/263 X |
| 3,181,203 | 5/1965 | Wenger | 52/6 |
| 3,258,884 | 7/1966 | Wenger | 52/6 |

FOREIGN PATENTS OR APPLICATIONS

| | | | |
|---|---|---|---|
| 1,475,402 | 2/1967 | France | 52/126 |

*Primary Examiner*—John E. Murtagh
*Attorney, Agent, or Firm*—Norman S. Blodgett; Gerry A. Blodgett

[57] ABSTRACT

This invention has to do with a portable rostrum and, more particularly, to apparatus arranged to provide a stage for educational purposes and the like, which stage can be dis-assembled and carried to a remote area and re-erected without difficulty.

3 Claims, 4 Drawing Figures

PORTABLE ROSTRUM

This is a continuation of application Ser. No. 311,629 filed Dec. 4, 1972, now abandoned, which is a division of patent application Ser. No. 141,942 filed May 10, 1971, now abandoned, which is a continuation of patent application Ser. No. 39,647 filed May 22, 1970, now abandoned, which is a division of patent application Ser. No. 849,561 filed July 23, 1969, now U.S. Pat. No. 3,531,898 which issued Oct. 6, 1970, which is a continuation of patent application Ser. No. 640,590 filed May 23, 1967, now abandoned.

BACKGROUND OF THE INVENTION

In the educational and entertainment field, it is often necessary to bring the facilities to the audience, rather than vice versa. Furthermore, a well-constructed and arranged rostrum is a very expensive piece of equipment and it is economically wasteful if it is permanently installed in one place and cannot be dis-mantled and re-erected in another place. This is true, for instance, in the training of Army technicians in that the facilities for teaching may be moved from a building in one section of the United States to a building thousands of miles away. In the past, it was necessary to construct entirely new rostrum facilities at the new location of the school. Even in the case of permanent rostrums, difficulties are experienced because of the impossibility of replacing parts and because of the fact that the floor of the rostrum may become worn. These and other difficulties experienced with the prior art devices have been obviated in a novel manner by the present invention.

It is, therefore, an outstanding object of the invention to provide a portable rostrum which may be easily dis-mantled and re-erected.

Another object of this invention is the provision of a portable rostrum in which all of the elements are of standard construction and may be readily replaced when broken or worn.

A further object of the present invention is the provision of a portable rostrum which is simple in construction, which is inexpensive to manufacture, and which is capable of a long life of useful service with a minimum of maintenance.

It is another object of the instant invention to provide a portable rosturm rostrum which the floor of the podium can be covered with rug material which may be changed around to minimize wear and which rug elements may be readily replaced without replacing the entire surface of the podium.

A still further object of the invention is the provision of a portable rostrum in which means is provided for suitably supporting projectors and the like yet, wherein all of the elements of the rostrum may be dismantled and stored in a very compact space for shipment.

It is a further object of the invention to provide a portable rostrum in which all of the elements are readily folded into compact packages.

With these and other objects in view, as will be apparent to those skilled in the art, the invention resides in the combination of parts set forth in the specification and covered by the claims appended hereto.

SUMMARY OF THE INVENTION

In general, the present invention consists of a portable rostrum comprising a podium of rectangular form, two angularly-arranged side walls and a rear wall arranged to enclose a trapezoidal portion of the podium, a trapezoidal-shaped roof connecting the upper edges of the walls and overlying the trapezoidal portion of the podium, and a lectern mounted on the said trapezoidal portion of the podium. Furthermore, the side walls are constructed to include projection screens and the rear wall includes a chalk board, while the roof includes light elements and the lectern carries a microphone connected to loud speakers. The projection screens are translucent and a mirror is provided to the rear of the side walls to reflect an image from a projector onto the translucent screen. The projectors are mounted in closets and shelves provided at the rear of the walls and are suitably hidden on occasion. The illuminating elements in the roof are foldable for ease in shipping. A plurality of display boards are slidable on a track across the rear wall to provide for a selection of the particular display board and to provide a closure for a projector shelf located behind that wall. The display boards are adapted to carry indicia which luminesce in the presence of ultraviolet light and the roof is provided with a flange at the forward end overlying the front edge of the podium or stage which carries an ultraviolet source directed toward these display boards. The podium is made up of a plurality of generally rectangular elements, each of which carries a replaceable rug element on its upper surface. The floor elements can be locked together to form any shape of podium desired and can be interchanged.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
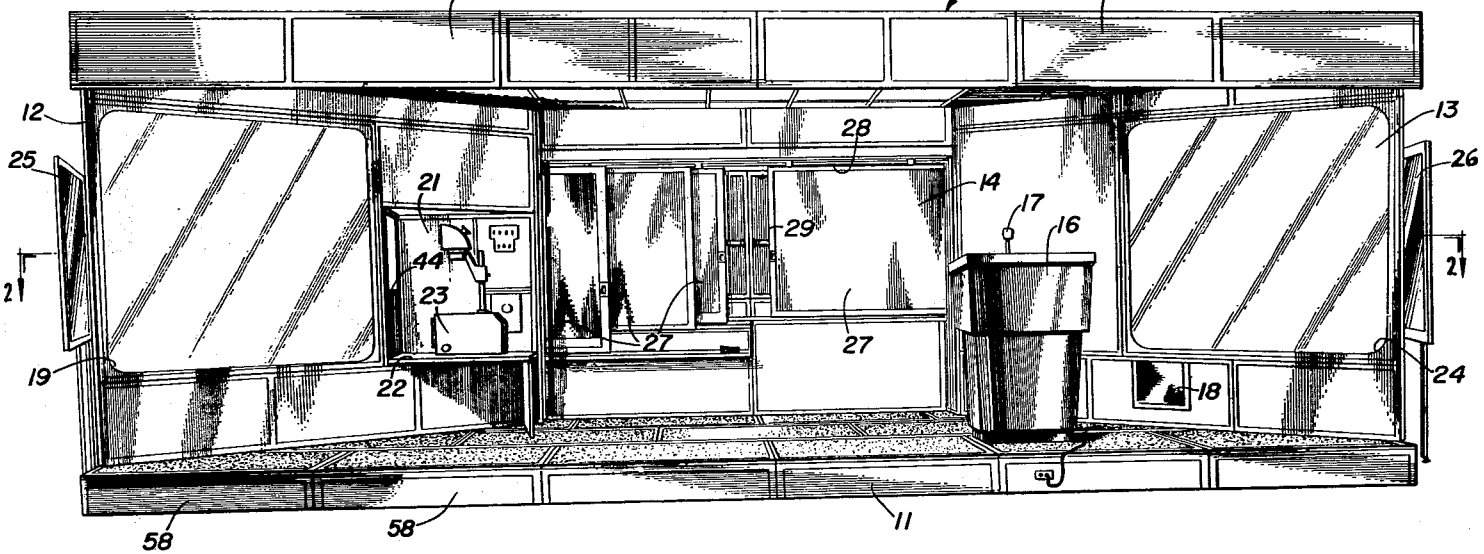
FIG. 1 is a perspective view of a portable rostrum embodying the principles of the present invention.
Figure 2:
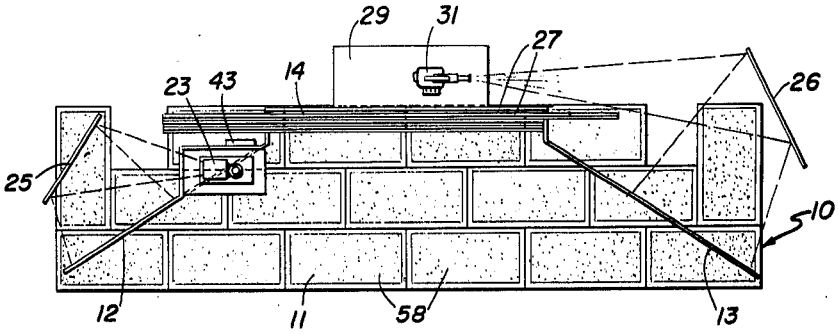
FIG. 2 is a horizontal sectional view of the rostrum taken on the line 2—2 of FIG. 1.

Referring first to FIGS. 1 and 2, wherein are best shown the general features of the invention, the portable rostrum, indicated generally by the reference numeral 10, is shown as consisting of a general rectangular podium 11 on which are arranged two angular side walls 12 and 13 and a rear wall 14 which serve to present to the audience a trapezoidal shaped portion of the podium. A roof 15 is mounted across the tops of the side walls 12 and 13 and the rear wall 14 and in general is trapezoidal-shaped to match the portion of the podium exposed to the audience. Mounted on the podium is a lectern 16 having a microphone 17 connected to a loud speaker 18.

As is evident in FIG. 1, the side wall 12 is provided with a translucent projection screen 19 and with a closet 21 having a projector shelf 22 on which is carried an overhead projector 23. The side wall 13 is also provided with a translucent projection screen 24. Mounted on the podium behind the side wall 12 is a mirror 25 and behind the side wall 13 is a mirror 26.

The rear wall 14 is provided with a plurality of display boards 27 Slidably mounted on a track 28, the boards in certain positions covering a projector shelf 29 which is located behind the wall 14 and which carries a moving-picture projector 31.

Figure 3:
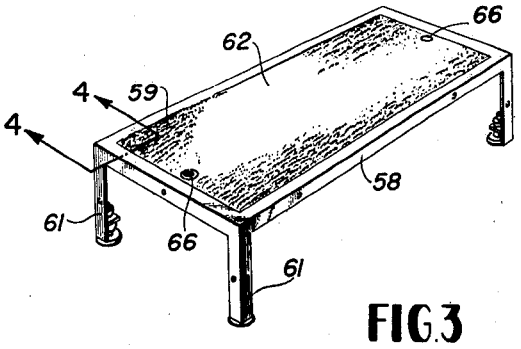
FIG. 3 is a perspective view of a floor unit associated with the podium.
Figure 4:
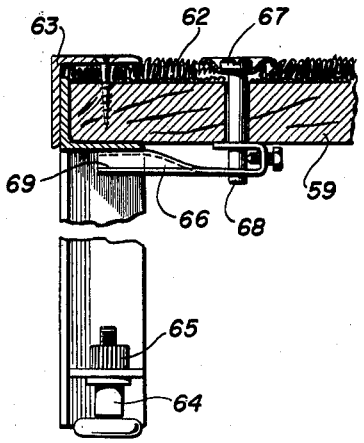
FIG. 4 is a sectional view of the unit taken on the line 4—4 of FIG. 3.

FIGS. 3 and 4 show the details of the units 58 from which the podium 11 is formed. Each unit consists of a rectangular floor resting on a rectangular angle-iron frame having at each corner a short leg 61. Fastened to the upper surface of the floor 59 is a rectangular piece of rug material 62 which is approximately the same size as the floor itself. As is evident in FIG. 4, the edge of this rug is held onto the floor by the use of an angle-piece 63, one leg of the angle-piece overlying the edge of the rug element and the other leg extending downwardly along the edge of the floor. Each leg is provided with an adjusting screw 64 having a locking nut 65. The units are held together by clamps, not shown. At each end of the unit in the central portion of its short sides it is provided with a fastening means 66 consisting of a bolt 67 extending through the floor and having a slotted head which appears in the upper suface of the unit. It also has a lower shaft 68 on which is mounted a finger 68 which is capable of engaging and locking with the frame to lock the floor in place. The floor 59 and the rug element 62 are both removable to permit the clamping and bolting of the frames together and getting them all level before the floors are put back in. This gives the person putting the podium together access to the bolts and clamps which fasten the legs and metal parts together.

The operation of the apparatus will now be readily understood, in view of the above description. First of all, in the assembled form shown in FIG. 1, it is possible for the lecturer or teacher to stand at the lectern 16 and address the audience through the microphone 17 and the loudspeaker 18. In order to show certain educational materials, he may make use of the projector 23 which, in the preferred embodiment, is shown as an overhead projector. The image from this projector is thrown against the mirror 25 and is reflected backwardly against the translucent screen 19. On occasion he may wish to show moving pictures, in which case he may make use of the projector 31 which throws the image against the mirror 26 from which it is projected onto a rear surface of the translucent screen 24. On occasion he will make use of the display boards 27, some of which have slate surfaces for use with chalk, while others have metal surfaces which are capable of holding magnetic-type indicia or indicia which are responsive to ultraviolet light. For that purpose, the ultraviolet light has its light directed toward the display boards 27 to bring that material into operation. A general area of the podium is illuminated by the light source. It will be understood that the roof 15 may be made up of the usual T-cross-section bars which permit the use of acoustical ceiling panels which drop into the horizontal flanges formed by these roof members. The light source 32 would be of a size to occupy two standard ceiling panel squares and the ceiling underlying the unit would be formed of translucent glass so that there would be no open spaces.

The dis-assembly and shipping of the entire unit is relatively easy. The roof is made up of ceiling panels which are easily removed and of structural members which are only bolted together. After the projectors 23 and 31 have been removed, their respective shelves and closets can be folded flat against their respective wall members. Each of the side wall members 12 and 13 and the rear wall 14 are separately shippable. The podium 11 is reduced to separate units 58 by unfastening the clamps and it is then only necessary to handle the individual units.

It should be pointed out in connection with the units 58 that, because of the use of the rug element 62, the floor of the podium is soft and soundproof. There is no noise to interfere with the lecture. As a matter of fact, since the ceiling is formed of acoustical ceiling tiles, and the floor has rug material on it, the sound-absorbing characteristics of the rostrum are quite good. In addition, when the motion picture projector 31 is operating, it is possible to cover the opening in the wall by means of the display boards 27; these boards are also basically formed of a porous acoustical material, so that the mechanical sounds of the projector does not interfere with the sound track of the projector which, incidentally, would provide sound through the loudspeaker 18. However, one of the major problems with providing a podium with rug material is that the podium is apt to be used mostly in the vicinity of the lectern 16 and certain spots become worn more than others. With the present device, it is possible to interchange the units 58 so that all of the units receive even wear. In addition, the removal of a rug unit and the replacement with another is a simple matter of removing the angle-pieces 63 and replacing the rug material. The rug material need not be bound because the edges are securely held under the angle-pieces 63.

It can be seen, then, that by use of the present invention it is possible to provide a podium which is truly portable in the sense that it can be dis-assembled into parts which are easily handled, which parts are not bulky since all of the elements are constructed to fold flat. It is a simple matter to remove the parts from one location to another. In addition, all of the elements are of the standard type so that it is easy to replace a part which becomes broken or worn. This is particularly true in the case of the units 58 forming the podium which, in the normal course of events, would take the greatest amount of punishment. Also, since each unit is provided with four adjustable legs, it is possible to set up the podium 11 perfectly level before the other elements are attached to it.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A portable rostrum, comprising a. a unit adapted to be connected to similar units, the unit consisting of a rectangular main frame from each corner of which extends a short leg, the frame being formed of angle iron with an upwardly-extending flange extending around its periphery to form a recess, and an inwardly- and horizontally-extending flange defining an opening, b. a continuous rigid rectangular floor removably carried in the recess and covering the opening, the floor having its upper surface covered with a rug material, c. a fastening means extending downwardly from the floor and movable from a first position in which the floor is removable from the frame to a second position in which the fastening means engages the underside of the frame and locks the floor in the frame against removal, d. a controller positioned at the upper surface of the floor and adapted to effect the movement of the fastening means when the controller is rotated, and e. a clamp adapted to hold the unit in contact with the similar units.

2. A portable rostrum as recited in Claim 1, wherein the fastening means consists of a shaft rotatably mounted in and extending vertically through the floor with the controller at its upper end and an arm non-rotatably mounted on the lower end of the shaft for movement from the said first position to the said second position.

3. A portable rostrum as recited in Claim 1, wherein the floor is provided with a peripheral frame of angle iron having an inwardly-directed horizontal flange that overlies the rug material and clamps it in place and a downwardly-directed flange which lies out side the main frame, the peripheral frame being attached to the floor by releasable fasteners which allow non-destructive release of the peripheral frame and thereby the rug material from the floor and subsequent reattachment.

* * * * *